US005749348A

United States Patent [19]

Oviedo-Reyes

[11] Patent Number: 5,749,348

[45] Date of Patent: May 12, 1998

[54] SEPARATING STOCK HYDRAULIC CROSSBOW

[76] Inventor: Alfonso Oviedo-Reyes, 730 NW. 106 Ave., Unit 2, Miami, Fla. 33172

[21] Appl. No.: 606,560

[22] Filed: Feb. 26, 1996

[51] Int. Cl.[6] ..... F41B 5/12

[52] U.S. Cl. ..... 124/25

[58] Field of Search ..... 124/25, 35.1, 37, 124/88, 86, 23.1

[56] References Cited

U.S. PATENT DOCUMENTS

| | | | |
|---|---|---|---|
| 2,786,461 | 3/1957 | Pelsue, Jr. | 124/25 |
| 3,006,330 | 10/1961 | De Bach | 124/25 X |
| 3,269,380 | 8/1966 | Stevens | 124/25 |
| 3,561,419 | 2/1971 | Cucuzza, Sr. | 124/25 |
| 4,041,927 | 8/1977 | Van House | 124/61 |
| 4,169,456 | 10/1979 | Van House | 124/61 |
| 4,594,994 | 6/1986 | Williams | 124/25 |
| 4,603,676 | 8/1986 | Luoma | 124/35.1 X |
| 4,732,134 | 3/1988 | Waiser | 124/25 |
| 4,942,861 | 7/1990 | Bozek | 124/25 |
| 5,115,795 | 5/1992 | Farris | 124/25 X |
| 5,220,906 | 6/1993 | Choma | 124/25 |
| 5,222,473 | 6/1993 | Lint | 124/86 |
| 5,445,139 | 8/1995 | Bybee | 124/25 X |

*Primary Examiner*—John A. Ricci
*Assistant Examiner*—Thomas A. Beach
*Attorney, Agent, or Firm*—Frank L. Kubler

[57] ABSTRACT

A crossbow apparatus includes a rearward stock portion including a bow string engaging structure; a forward stock portion including a bow fitted with a bow string; and a hydraulic drive mechanism interconnecting the rearward stock portion and the forward stock portion for separating the rearward stock portion and the forward stock portion while the bow string is engaged by the engaging structure to draw the bow. The forward stock portion preferably includes a longitudinal passageway and the rearward stock portion preferably includes a forwardly protruding guide rod slidably fitting into the longitudinal passageway for strengthening and stabilizing the apparatus when the forward stock portion and the rearward stock portion are separated. The rearward stock portion preferably includes the hydraulic drive mechanism base containing a fluid accumulation reservoir, a plunger slidably extensible from the base under pressure of hydraulic fluid within the reservoir, and a fluid pump for delivering fluid into the reservoir under pressure greater than atmospheric pressure. The rearward stock portion preferably contains a cavity and the base is retained within the cavity, and the plunger has a plunger forward end and the plunger forward end is preferably secured to the forward stock portion.

12 Claims, 2 Drawing Sheets

SEPARATING STOCK HYDRAULIC CROSSBOW

BACKGROUND OF THE INVENTION

1. Field of the Invention

The present invention relates generally to the field of archery equipment. More specifically the present invention relates to a crossbow including a forward stock portion fitted with a conventional bow and a separate rearward stock portion fitted with a conventional bow string engaging trigger mechanism. A projectile guide channel is recessed into the upper surfaces of the forward and rearward stock portions. These stock portions are interconnected by a hydraulic drive mechanism, similar in construction to a hydraulic jack. Stock portion guide rods longitudinally protrude from the rearward stock portion and slidably fit into longitudinal passageways within the forward stock portion.

To use the crossbow, the bow string is first placed in a trigger mechanism catch. Then fluid within the hydraulic drive mechanism is pumped to advance a hydraulic plunger and thereby progressively separate the forward and rearward stock portions. This separation creates tension in the string and draws the bow. Once a desired draw position is reached, the user stops pumping the drive mechanism and loads a projectile such as a bolt into the projectile guide channel. The user applies pressure to a trigger mechanism lever and thereby mechanically releases the bow string from the catch. The string accelerates with the resilience of the bow and launches the projectile.

2. Description of the Prior Art

Archery bows are known to have been used in ancient Egypt at least 5000 years ago. *Funk & Wagnalls New Encyclopedia,* 1979, Volume 2, page 211. Many centuries later, the crossbow evolved as a specialized variation of the longbow. During Hundred Years' War, mercenary crossbowmen from Genoa were instrumental in decimating half of French army at the 1346 Battle of Crecy. Yet the military value of the early crossbows was limited because they lacked the range of and were slower to cock and load than many of the long bows. *Complete Book of the Bow and Arrow,* G. Howard Gillelan, Stackpole Books (1977), pages 14–15. While crossbows have been effective in a variety of military situations and have also entertained sportsmen, even contemporary crossbows are notoriously slow and awkward to cock.

> "Cocking the crossbow has always been something of a problem. After a longbowman takes a shot, he merely reaches into his quiver for another arrow, puts it in position, and draws. The crossbowman must go through a more complicated procedure. At one time, a variety of devices were used, ranging from a stirrup to hold the front end to a ratchet-type crank, or handles which were turned in order to draw back the bowstring. Now, crossbowmen cock their weapons by hand, some of them hooking the front end to a stake in the ground. While using both hands, they haul back on the string far enough to position it. The string is drawn back and secured in a catch on the stock. When the trigger is pulled, the catch releases the bowstring and the bolt is discharged. . . . In 1970, one of the established archery manufacturers introduced a new crossbow. It has the foot stirrup up front for cocking, . . . "

*Complete Book of the Bow and Arrow,* pages 36–37.

To make cocking the bow faster and easier, and to increase the power and range of the crossbow, some hydraulic cocking mechanisms have been developed. These include Curcuzza, Sr., U.S. Pat. No. 3,561,419, issued on Feb. 9, 1971, which teaches a projectile launcher including an impeller within a barrel and an impeller retractor which draws the impelled back against elastic biasing, such as from a bow string, using fluid pressure. The impeller is connected to the impeller retractor by coupling means. Curcuzza, Sr. FIGS. 10–13 show the hydraulic cocking action. Problems with Curcuzza, Sr., are that the combined retracting and impelling mechanism is highly complex, and would be costly to produce and subject to mechanical failure.

Choma, U.S. Pat. No. 5,220,906, issued on Jun. 22, 1993, discloses a crossbow after-market accessory for drawing the bow. Choma teaches an electric motor for rotating and advancing a threaded shaft to retract the bow string and bow. Choma states as an alternative, however, that "shaft 22 may be moved by hydraulic pressure or the like." See column 3, line 55. A problem with Choma is that there is no explanation of exactly how hydraulics might be implemented for this purpose. Another problem with Choma is that it must be secured to an existing crossbow when the bow is to be drawn.

Two patents issued to Van House disclose archery bows with substantially rigid bow arms which use compressed gas as the spring means for accelerating a projectile. U.S. Pat. No. 4,041,927, issued on Aug. 16, 1977, recites "A gas spring 6 . . . made up of a piston 7 and cylinder 8" which can be adjusted to give different draw forces. See column 2, lines 41–45 and 59–66 generally. U.S. Pat. No. 4,169,456, issued on Oct. 2, 1979, states "As piston 50 moves rearwardly, air or other gas confined within the motor 48 is compressed. In full draw position . . . the air or other gas confined within the motor 48 represents stored energy urging the piston 50 forwardly . . . " See column 3, lines 43–65, generally. A problem with the Van House devices is that they do not teach a means for efficiently drawing conventional elastic bow arms.

It is thus an object of the present invention to provide a hydraulic crossbow which provides a high power draw against high resistance elastic bow arms for enhanced shooting range and accuracy.

It is another object of the present invention to provide such a crossbow which permits rapid cocking to varying degrees of bow arm draw for selected levels of firing power, and with minimal physical exertion by the user.

It is still another object of the present invention to provide such a crossbow which separates the trigger mechanism from the drawing mechanism for greater simplicity, sturdiness and servicing convenience.

It is a further object of the present invention to provide such a crossbow which retracts to a compact size for convenient storage and transport.

It is finally an object of the present invention to provide such a crossbow which is reliable and relatively inexpensive to manufacture.

SUMMARY OF THE INVENTION

The present invention accomplishes the above-stated objectives, as well as others, as may be determined by a fair reading and interpretation of the entire specification.

A crossbow apparatus is provided including a rearward stock portion including a bow string engaging structure; a forward stock portion including a bow fitted with a bow string; and an interconnection structure interconnecting the rearward stock portion and the forward stock portion including a hydraulic drive mechanism for driving apart the rearward stock portion and the forward stock portion while the bow string is engaged by the engaging structure to draw the bow. The forward stock portion preferably includes a longitudinal passageway and the rearward stock portion preferably includes a forwardly protruding guide rod slidably fitting into the longitudinal passageway for strengthening and preventing relative rotation between forward stock portion and the rearward stock portions when they are driven apart. The rearward stock portion preferably includes the hydraulic drive mechanism base containing a fluid accumulation reservoir, a plunger slidably extensible from the base under pressure of hydraulic fluid within the reservoir, and a fluid pump for delivering fluid into the reservoir under pressure greater than atmospheric pressure. The rearward stock portion preferably contains a cavity and the base is retained within the cavity, and the plunger forward end is preferably secured to the forward stock portion.

The hydraulic drive mechanism preferably additionally includes a fluid holding chamber and a fluid release device for releasing the fluid from the reservoir into the holding chamber to permit movement of the forward stock portion and the rearward stock portion toward each other, after the forward stock portion and the rearward stock portion have been driven apart by the hydraulic drive mechanism. The crossbow preferably additionally includes a return biasing structure for automatically moving the forward stock portion and the rearward stock portion toward each other upon activation of the release device.

A crossbow apparatus is provided including a rearward stock portion including a bow string engaging structure; a forward stock portion including a bow with a bow string; and an interconnection structure interconnecting the rearward stock portion and the forward stock portion including a drive mechanism for driving apart the rearward stock portion and the forward stock portion while the bow string is engaged by the engaging structure, to draw the bow. The drive mechanism preferably includes a release device for releasing the drive mechanism to permit movement of the forward stock portion and the rearward stock portion toward each other, after the forward stock portion and the rearward stock portion have been driven apart by the drive device. The crossbow preferably additionally includes a return biasing structure for automatically moving the forward stock portion and the rearward stock portion toward each other upon activation of the release device. The forward stock portion preferably includes a longitudinal passageway and the rearward stock portion preferably includes a forwardly protruding guide rod slidably fitting into the longitudinal passageway for strengthening and preventing relative rotation between the forward stock portion and the rearward stock portion when they are driven apart.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
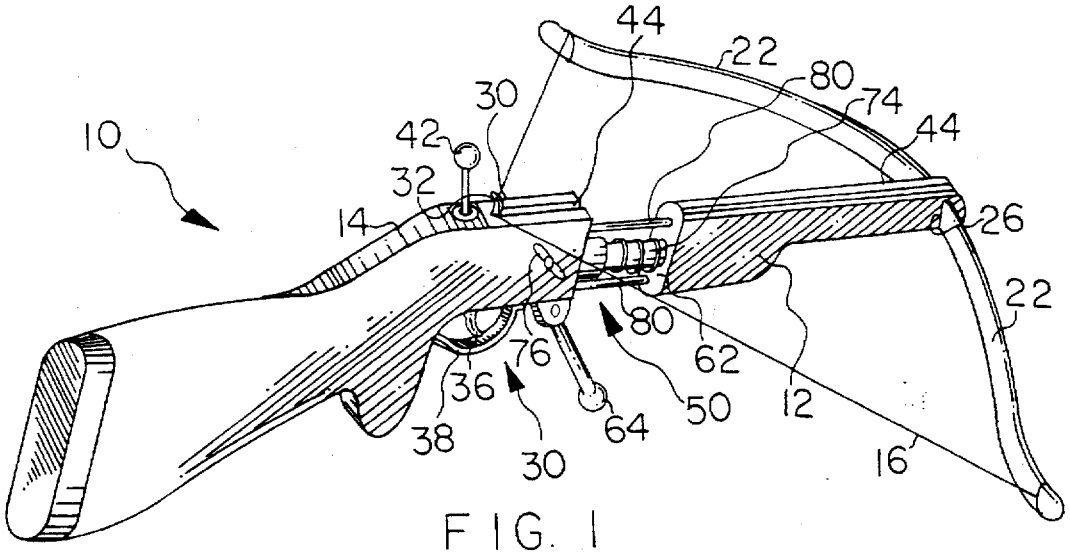
FIG. 1 is a perspective view of the inventive crossbow in a drawn position, without a projectile in the guide channel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 2:
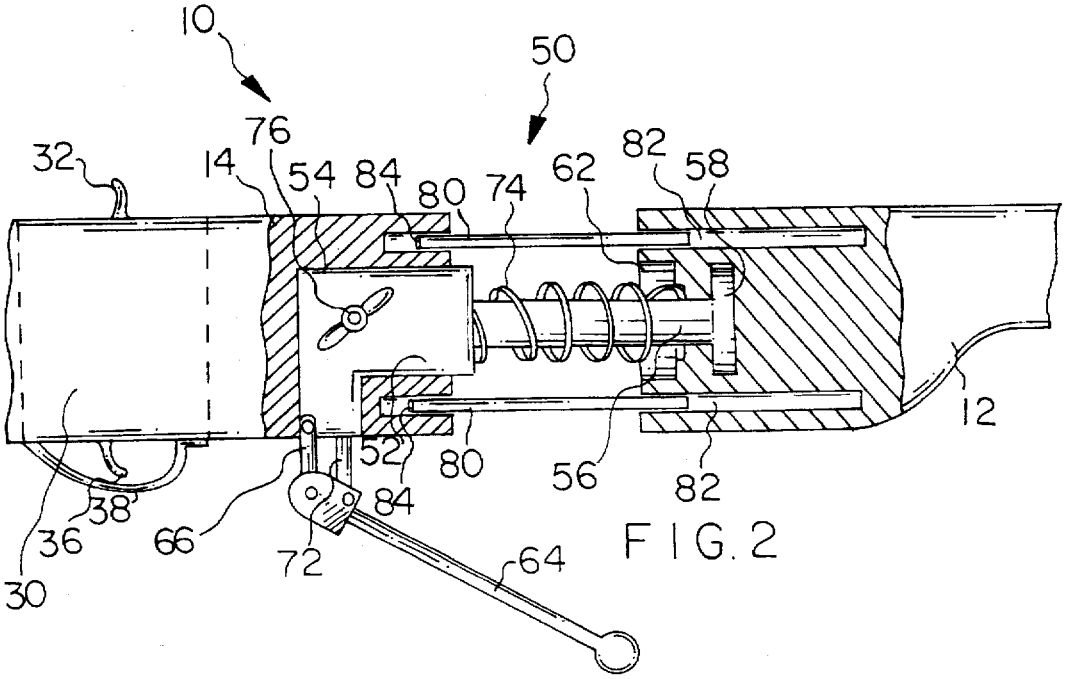
FIG. 2 is a broken away partial cross-section of the stock portions in a bow drawing position, revealing the locations and the relationships between the various parts of the hydraulic drive mechanism, the guide rods and the passageways.
Figure 3:
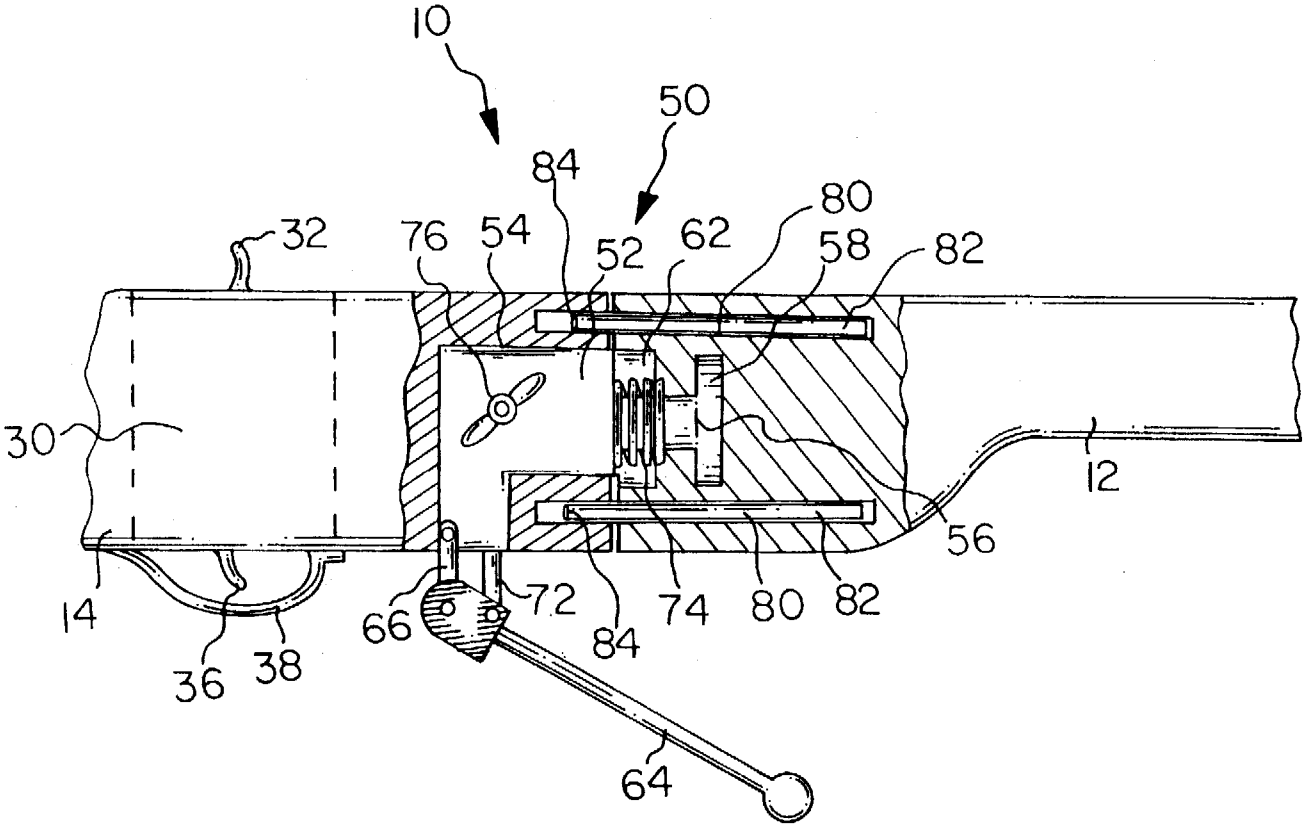
FIG. 3 is a view as in FIG. 2 with the stock portions in a retracted, mutually abutting non-firing position.

Referring to FIGS. 1–3, a crossbow 10 is disclosed including a forward stock portion 12 and a separate rearward stock portion 14. Forward and rearward stock portions 12 and 14, respectively, are separated with hydraulic means to draw the bow into a firing position.

The forward stock portion 12 is fitted with a conventional resilient bow 22 passing through and secured within a bow slot 26. The rearward stock portion 14 is fitted with a conventional trigger mechanism 30, having a bow string engaging catch 32 protruding upwardly from the upper surface of rearward stock portion 14. Trigger mechanism 30 extends downwardly through rearward stock portion 14 and a conventional trigger lever 36 within a trigger lever guard ring 38.

A sight 42 is preferably provided just behind trigger mechanism 30 to help the user aim crossbow 10. A projectile guide channel 44 is provided in the upper surfaces of the rearward and forward stock portions 12 and 14, respectively, to retain and guide a bolt, arrow, pellet or other projectile or missile.

Forward stock portion 12 and rearward stock portion 14 are interconnected by an extensible structure including a hydraulic drive mechanism 50 which drives stock portions 12 and 14 apart from each other. Drive mechanism 50 is essentially a hydraulic jack. A hydraulic reservoir base 52 is snugly retained within a base mounting cavity 54 inside rearward stock portion 14. The forward end of base 52 preferably protrudes forwardly out of rearward stock portion 12 and fits into a corresponding recess 62 in forward stock portion 14 for added stock strength when the crossbow 10 is retracted.

A drive plunger 56 slidably protrudes forwardly out of base 52 and includes an anchoring lip 58 extending radially outward from the plunger 56 forward end. Anchoring lip 58 is securely embedded in forward stock portion 14, to such a depth that forward and rearward stock portions 12 and 14, respectively, abut each other when drive plunger 56 is retracted into base 52. When plunger 56 is advanced out of base 52 a certain distance, stock portions 12 and 14 are therefore separated from each other by an equivalent distance.

Plunger 56 is advanced from base portion 52 by operating a drive pump lever 64 pivotally extending from a linkage 66, which is in turn, pivotally connected to base 52, and bearing against a drive pump piston 72. Pivoting lever 64 axially reciprocates drive pump piston 72 to pump hydraulic fluid into a reservoir of conventional hydraulic jack design within base 52. Fluid entering the reservoir drives plunger 56 outwardly and forwardly, to separate stock portions 12 and 14. Plunger 56 may be retracted to permit forward and rearward stock portions 12 and 14 to move toward each other, and preferably to abut, each other, by opening a fluid valve with a valve handle 76 on the side of rearward stock portion 14. This fluid valve opens a port between the reservoir and a fluid holding chamber within base 52 through which the hydraulic fluid can escape from the reservoir into the chamber. A return spring 74 is preferably provided to bias forward and rearward stock portions 12 and 14 toward each other, so that opening the fluid valve causes stock portions 12 and 14 to retract together automatically. Hydraulic drive means 50 might equivalently be mechanically connected to an extensible stock portion interconnecting member. Mechanical drive devices other than hydraulic mechanisms, such as rack and ratchet structures similar to those used in automobile jacks, are contemplated.

Stock portion guide rods 80 preferably protrude forwardly from rearward portion 14, where they are anchored with spring pins 84, and slidably fit into guide passageways 82 bored longitudinally into forward stock portion 12. Passageways 82 are preferably lined with metal or plastic tubes (not shown) which each receive a guide rod 80, to better retain guide rod lubrication material. Guide rods 80 strengthen crossbow 10 and prevent relative rotation between the forward stock portion 12 and the rearward stock portion 14 when these stock portions 12 and 14, respectively, are spaced apart from each other by drive mechanism 50. An accordion sleeve (not shown) optionally encloses and conceals the gap between the stock portions when they are separated.

Method

In practicing the invention, the following method may be used. To operate crossbow 10, the bow string 16 is hooked onto catch 32, the fluid valve is closed with valve handle 76, drive pump lever 64 is pivoted to drive the forward and rearward stock portions 12 and 14, respectively, apart from each other to create tension in string 16 and thereby draw bow 22 back into a desired firing position. Then a bolt, arrow, pellet or other projectile (not shown) is placed in guide channel 44 adjacent to string 16 in a conventional way. Crossbow 10 is aimed and trigger lever 36 is pulled in an ordinary way to release string 16 from catch 32 and release the energy stored in resilient bow 22 to act upon and launch the projectile longitudinally out of crossbow 10. The fluid valve is then opened to permit the stock portions to retract together.

The degree of draw and thus the degree of firing power can be infinitely varied by selecting the extent of stock portion separation, which is accomplished by ceasing operation of lever 64 at the proper moment. A light draw could be appropriate where the crossbow 10 is operated at a site other than a range, to prevent possible injury to bystanders and to make fired projectiles easier to find and retrieve.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A crossbow apparatus comprising:

a crossbow stock comprising a rearward stock portion including bow string engaging means, and a forward stock portion including a bow fitted with a bow string;

and interconnection means interconnecting said rearward stock portion and said forward stock portion including hydraulic drive means for driving apart said rearward stock portion and said forward stock portion while said bow string is engaged by said engaging means to draw said bow, such that said crossbow stock increases in length as said rearward stock portion and said forward stock portion separate.

2. The apparatus of claim 1, wherein said forward stock portion comprises a longitudinal passageway and wherein said rearward stock portion comprises a forwardly protruding guide rod slidably fitting into said longitudinal passageway for strengthening and preventing relative rotation between said forward stock portion and said rearward stock portion when said stock portions are driven apart from each other.

3. The apparatus of claim 1, wherein said rearward stock portion comprises a hydraulic drive means base containing a fluid accumulation reservoir, a plunger slidably extensible from said base under pressure of hydraulic fluid within said reservoir, and fluid pumping means for delivering fluid into said reservoir under pressure greater than atmospheric pressure.

4. The apparatus of claim 3, wherein said rearward stock portion contains a cavity and said base is retained within said cavity, and wherein said plunger has a plunger forward end and said plunger forward end is secured to said forward stock portion.

5. The crossbow of claim 3, wherein said hydraulic drive means additionally comprises a fluid holding chamber and fluid release means for releasing said fluid from said reservoir into said holding chamber to permit movement of said forward stock portion and said rearward stock portion toward each other, after said forward stock portion and said rearward stock portion have been driven apart by said hydraulic drive means, such that said crossbow stock decreases in length as said rearward stock portion and said forward stock portion move toward each other.

6. The crossbow of claim 5, additionally comprising return biasing means for automatically moving said forward stock portion and said rearward stock portion toward each other upon activation of said release means.

7. A crossbow apparatus comprising:

a crossbow stock comprising a rearward stock portion including bow string engaging means, and a forward stock portion including a bow fitted with a bow string;

and interconnection means interconnecting said rearward stock portion and said forward stock portion and including drive means for driving apart said rearward stock portion and said forward stock portion while said bow string is engaged by said engaging means, to draw said bow, such that said crossbow stock increases in length as said rearward stock portion and said forward stock portion are driven apart from each other.

8. The crossbow of claim 7, wherein said drive means comprises release means for releasing said drive means to permit movement of said forward stock portion and said rearward stock portion toward each other, after said forward stock portion and said rearward stock portion have been driven apart by said drive means.

9. The crossbow of claim 8, additionally comprising return biasing means for automatically moving said forward stock portion and said rearward stock portion toward each other upon activation of said release means.

10. The apparatus of claim 7, wherein said forward stock portion comprises a longitudinal passageway and wherein said rearward stock portion comprises a forwardly protruding guide rod slidably fitting into said longitudinal passageway for strengthening and preventing relative rotation between said forward stock portion and said rearward stock portion when said stock portions are driven apart from each other.

11. A crossbow apparatus comprising:

a rearward stock portion including bow string engaging means;

a forward stock portion including a bow fitted with a bow string;

interconnection means interconnecting said rearward stock portion and said forward stock portion including hydraulic drive means for driving apart said rearward stock portion and said forward stock portion while said bow string is engaged by said engaging means to draw said bow, said rearward stock portion containing a cavity and said base is retained within said cavity, and said plunger having a plunger forward end and said plunger forward end being secured to said forward stock portion, and said hydraulic drive means additionally comprising a fluid holding chamber and fluid release means for releasing said fluid from said reservoir into said holding chamber to permit movement of said forward stock portion and said rearward stock portion toward each other, after said forward stock portion and said rearward stock portion have been driven apart by said hydraulic drive means, and return biasing means for automatically moving said forward stock portion and said rearward stock portion toward each other upon activation of said release means.

12. A crossbow apparatus comprising:

a rearward stock portion including bow string engaging means;

a forward stock portion including a bow fitted with a bow string;

interconnection means interconnecting said rearward stock portion and said forward stock portion and including drive means for driving apart said rearward stock portion and said forward stock portion while said bow string is engaged by said engaging means, to draw said bow, said drive means comprising release means for releasing said drive means to permit movement of said forward stock portion and said rearward stock portion toward each other, after said forward stock portion and said rearward stock portion have been driven apart by said drive means, and return biasing means for automatically moving said forward stock portion and said rearward stock portion toward each other upon activation of said release means.

* * * * *